US008240148B2

(12) United States Patent
Matsumoto et al.

(10) Patent No.: US 8,240,148 B2
(45) Date of Patent: Aug. 14, 2012

(54) TURBINE SYSTEM AND METHOD FOR STARTING-CONTROLLING TURBINE SYSTEM

(75) Inventors: Shigeru Matsumoto, Yokohama (JP); Koji Yakushi, Tokyo (JP); Asako Inomata, Yokohama (JP); Eiji Nakagawa, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 718 days.

(21) Appl. No.: 12/469,302

(22) Filed: May 20, 2009

(65) Prior Publication Data

US 2009/0288416 A1 Nov. 26, 2009

(30) Foreign Application Priority Data

May 21, 2008 (JP) ..... 2008-133366

(51) Int. Cl.
*F01K 13/02* (2006.01)

(52) U.S. Cl. ..... 60/646; 60/657; 60/660

(58) Field of Classification Search ..... 60/646, 60/657, 660, 665

See application file for complete search history.

(56) References Cited

U.S. PATENT DOCUMENTS 4,181,840 A * 1/1980 Osborne ..... 290/40 R
5,388,960 A * 2/1995 Suzuki et al. ..... 415/176
2006/0233637 A1 10/2006 Yakushi et al.

FOREIGN PATENT DOCUMENTS

JP 9-317404 A 12/1997
JP 2006-257925 A 9/2006

* cited by examiner

*Primary Examiner* — Hoang Nguyen
(74) *Attorney, Agent, or Firm* — Foley & Lardner LLP

(57) ABSTRACT

The present invention provides a turbine system which can start a turbine, while controlling thermal stress generated in a turbine rotor and an expansion difference, due to thermal expansion, between a casing and the turbine rotor, to be lower than defined values, respectively. The turbine system (1) according to the present invention includes the turbine (4) having a casing (2) and the turbine rotor (3) rotatably attached to the casing (2), and a main steam pipe (5) connected to an upstream portion of the casing (2). A control valve (6) adapted for controlling a flow rate of steam discharging into the casing (2) is provided with the main steam pipe (5), and a power generator (7) is coupled with the turbine rotor (3). Additionally, a starting control system (10) is adapted for controlling the control valve (6), while obtaining an operational amount of the control valve (6).

9 Claims, 4 Drawing Sheets

TURBINE SYSTEM AND METHOD FOR STARTING-CONTROLLING TURBINE SYSTEM

BACKGROUND

1. Technology Field

The present invention relates to a turbine system adapted for starting-controlling a turbine having a casing and a turbine rotor rotatably attached into the casing, and also relates to a method for starting-controlling the turbine system. In particular, this invention relates to the turbine system adapted for starting the turbine, while controlling thermal stress generated in the turbine rotor as well as controlling an expansion difference, due to thermal expansion, between the casing and the turbine rotor, and also relates to the method for starting-controlling the turbine system.

2. Background Art

Generally, when the turbine is started, temperature of steam discharging into the casing of the turbine is elevated, while a flow rate of the steam is increased, so that the surface temperature of a metallic material located on the surface of the turbine rotor is first elevated. Then the heat of the surface of the turbine rotor is transmitted to the interior of the turbine rotor by heat conduction. Therefore, the internal temperature of the metallic material located in the turbine rotor is elevated later than the surface temperature of the metallic material on the surface of the turbine rotor. As a result, a difference of temperature distribution occurs between the surface and the interior of the turbine rotor, leading to thermal stress exerted on the turbine rotor. If such thermal stress is considerably great, the life span of the turbine rotor may be substantially shortened.

To address this problem, a system for controlling start of the turbine, such that the thermal stress generated in the turbine rotor of the turbine can be controlled to be lower than a defined value as well as the time required for starting the turbine can be made shorter, has been known (e.g., see Patent Documents 1 and 2).

In the system for starting-controlling the steam turbine described in the Patent Document 1, the start of the turbine is controlled, by obtaining a turbine-speed increasing ratio indicative of a ratio of changing the rotating speed of the turbine rotor and a load increasing ratio indicative of a ratio of increasing load of a power generator, such that the temperature of a first-stage metal located at a first stage on an outer circumference of the turbine rotor, or the like, can be changed in accordance with a predetermined changing pattern.

Meanwhile, the system for starting-controlling the turbine described in the Patent Document 2 is configured for performing calculation on the assumption that both of the turbine-speed increasing ratio of the turbine rotor and the load increasing ratio of the power generator are constant, thereby to substantially reduce the number of variables used in the calculation, thus facilitating the calculation.

Patent Document 1: JP9-317404A

Patent Document 2: JP2006-257925A

However, when the turbine is started, the temperature of the steam passing through a steam passage provided between the turbine rotor and the casing storing the turbine rotor therein is raised, and the flow rate of the steam increases. In this case, both of the turbine rotor and casing are expanded in a longitudinal direction of the turbine rotor. However, the material and the shape of the turbine rotor are different from the material and the shape of the casing respectively. Accordingly, an amount of expansion of the turbine rotor is different from the amount of expansion of the casing, and a tendency in change of the amount of expansion of the turbine rotor is different from the tendency in change of the amount of expansion of the casing. Therefore, an expansion difference, which is a difference in expansion between the turbine rotor and the casing, may be seriously great. In the worst case, a rotatable member provided to the turbine rotor may be in contact with a stationary member provided to of the casing.

SUMMARY

Accordingly, an advantage of this invention is to provide a turbine system adapted for starting the turbine, while controlling the thermal stress generated in the turbine rotor as well as the expansion difference, due to the thermal expansion, between the casing and the turbine rotor, to be lower than the defined values. Another advantage of this invention is to provide a method for starting-controlling this turbine system.

The turbine system according to one aspect of the present invention is a turbine system comprising: a turbine having a casing and a turbine rotor rotatably attached into the casing; a main steam pipe connected to an upstream portion of the casing of the turbine, a control valve provided with the main steam pipe, the control valve controls a flow rate of steam discharging into the casing, a power generator coupled with the turbine rotor; and a starting control system including a starting controller and a control-valve controller, wherein the starting controller, during a estimation time interval, estimates thermal stress generated in the turbine rotor and an expansion difference between the casing and the turbine rotor due to thermal expansion, based on conditions of the steam discharging into the casing, temperature of the turbine rotor and a temperature of the casing, wherein the starting controller, for each time step, calculates an operation pattern of the control valve during the estimation time interval such that the thermal stress and the expansion difference, estimated respectively, can be controlled to be lower than defined values, thereby obtaining an operational amount of the control valve based on the operation pattern and wherein the control-valve controller drives the control valve, based on the operational amount obtained by the starting controller.

Alternatively, the method for starting-controlling the turbine system according to one aspect of the present invention is a method for starting-controlling a turbine system including a turbine having a casing and a turbine rotor rotatably attached into the casing, a main steam pipe connected to an upstream portion of the casing of the turbine, a control valve provided with the main steam pipe, the control valve controls a flow rate of steam discharging into the casing, a power generator coupled with the turbine rotor, and a starting control system including a starting controller and a control-valve controller, wherein the method comprises:

estimating, by the starting controller of the starting control system, thermal stress generated in the turbine rotor during a estimation time interval, and an expansion difference, due to thermal expansion, between the casing and the turbine rotor, based on conditions of the steam discharging into the casing as well as a temperature of the turbine rotor and a temperature of the casing and then calculating an operation pattern of the control valve during the estimation time interval, for each time step, such that the thermal stress and the expansion difference estimated respectively can be controlled to be lower than defined values, respectively, thereby obtaining an operational amount of the control valve, based on the operation pattern; and driving the control valve by the control-valve controller of the starting control system, based on the operational amount of the control valve obtained by the starting controller.

According to these aspects of the present invention, the turbine may be rapidly started, regardless of driving conditions, while the thermal stress in the turbine rotor as well as the expansion difference between the turbine rotor and the casing can be controlled to be lower than the defined values, respectively. As such, accuracy of starting-controlling the turbine can be securely enhanced.

DETAILED DESCRIPTION

First Embodiment

Figure 1:
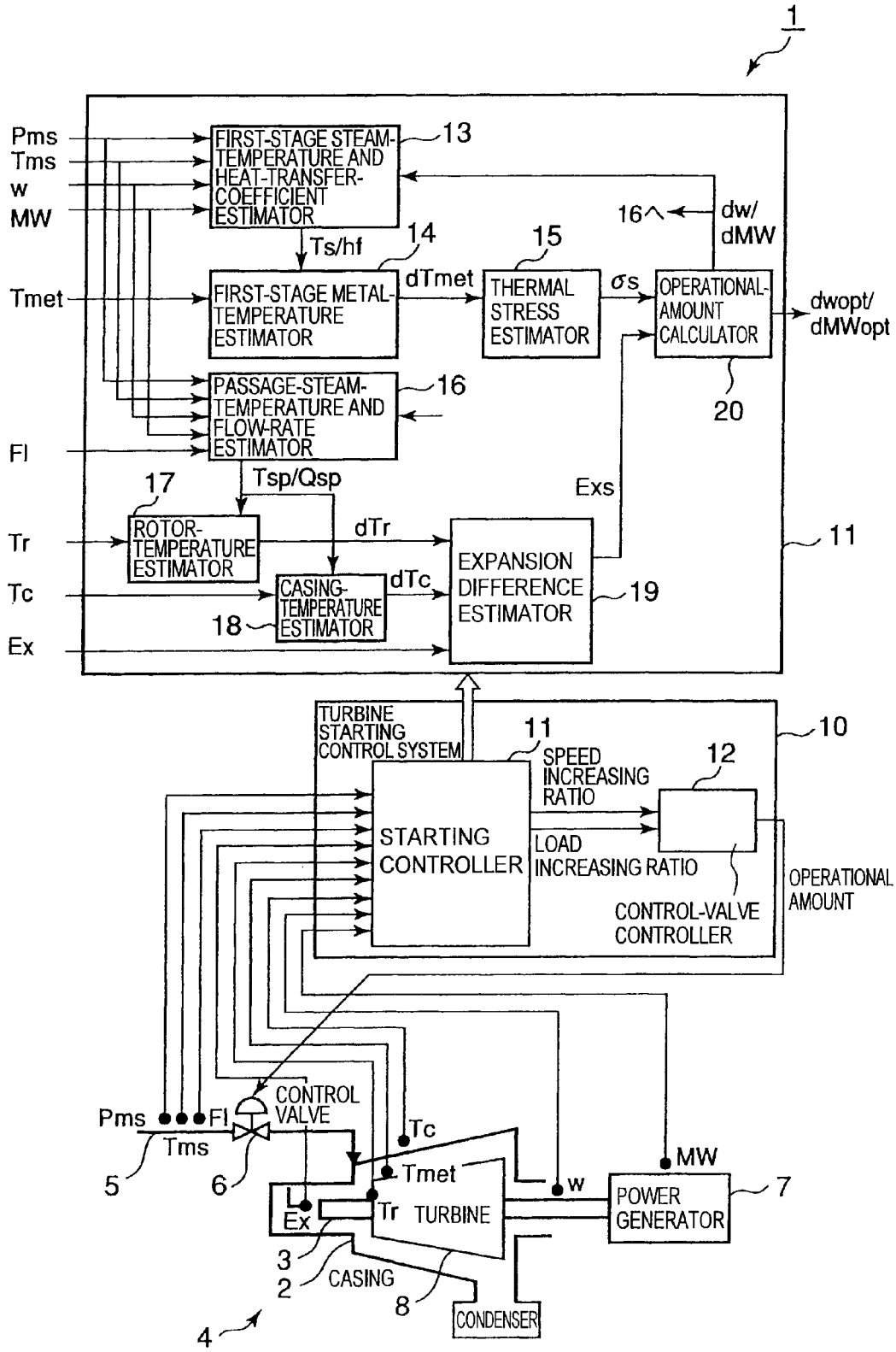
FIG. 1 is a schematic view showing a general construction of a turbine system related to a first embodiment.
Figure 2:
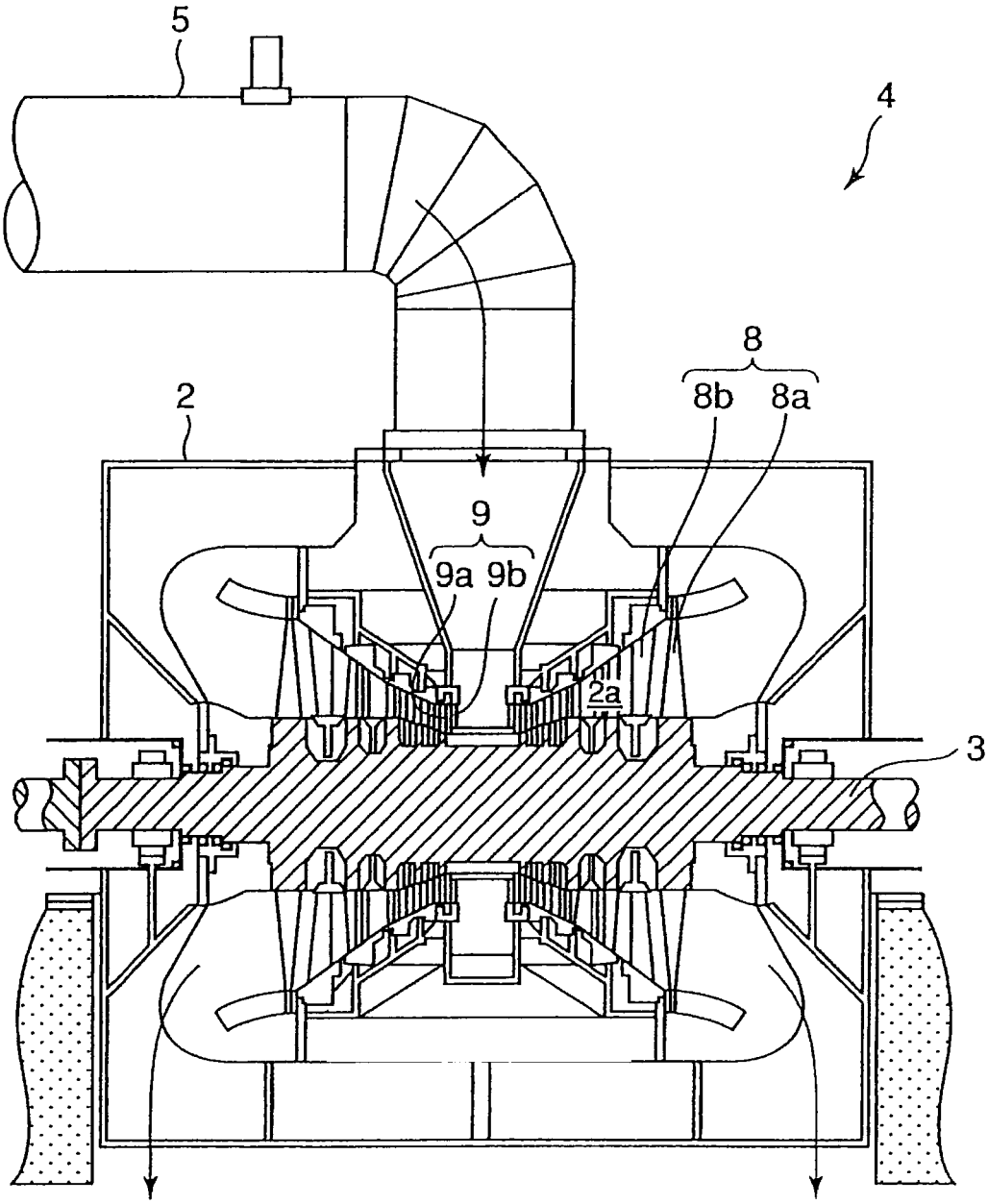
FIG. 2 is a view showing a construction of a turbine of the turbine system related to the first embodiment.
Figure 3:
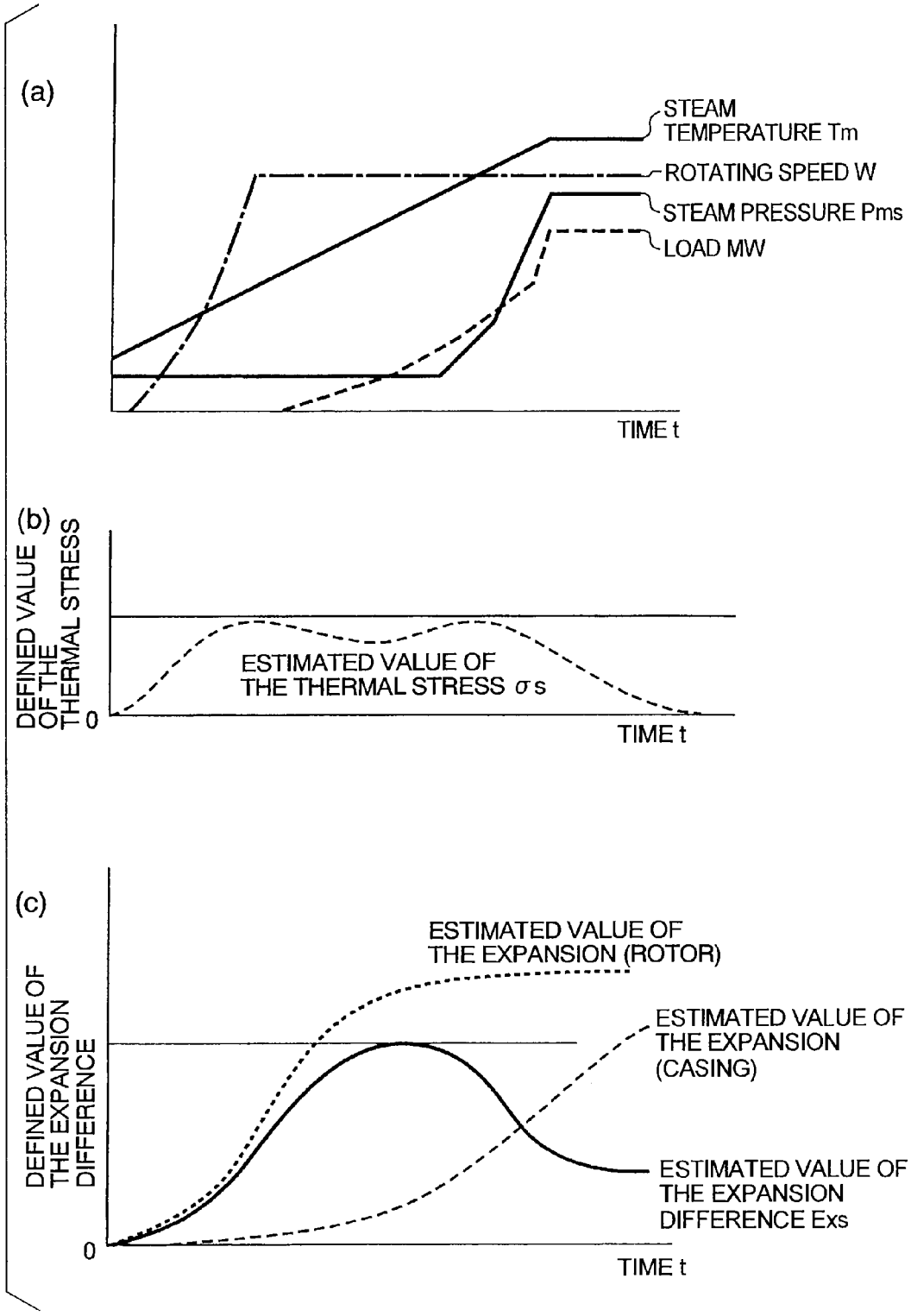
FIG. 3(*a*) is a view showing changes of a pipe steam pressure, a pipe steam temperature, rotating speed of the turbine and load on a power generator, when the turbine system related to the first embodiment of the present invention is started, FIG. 3(*b*) is a view showing a change of estimated thermal stress, and FIG. 3(*c*) is a view showing a change of an estimated expansion difference.

Hereinafter, embodiments of the present invention will be described, with reference to the drawings. FIGS. 1 to 3 illustrate a turbine system related to a first embodiment of the present invention, respectively.

First, referring to FIGS. 1 and 2, a general construction of the turbine system 1 according to the present invention will be described. This turbine system 1 is configured for starting-controlling a turbine 4 including a casing 2 and a turbine rotor 3 rotatably attached into the casing 2.

As shown in FIGS. 1 and 2, the turbine system 1 includes the turbine 4 including the casing 2 and turbine rotor 3 rotatably attached into the casing 2, and a main steam pipe 5 having one end connected to an upstream portion of the casing 2 and the other end connected to a steam generator (not shown), such as a boiler or the like. A control valve 6, which is adapted for controlling a flow rate of steam discharging into the casing 2 from the steam generator, is provided with the main steam pipe 5. A power generator 7 is coupled with the turbine rotor 3. Additionally, turbine moving blades 8*a* are provided on an outer circumference of the turbine rotor 3, and turbine nozzles 8*b* are provided in the casing 2. Each pair of the turbine moving blade 8*a* and turbine nozzle 8*b*, respectively provided in the circumferential direction, constitutes one stage 8. Thus, a plurality of stages 8 are arranged in an axial direction, forming a steam passage 2*a*. Among the stages 8, the one located on the most upstream side, i.e., the one located on the nearest side to the main steam pipe 5 which connected with the casing 2, is herein referred to as a first stage 9, which is composed of a turbine moving blade 9*a* and a turbine nozzle 9*b*. Incidentally, the steam passage 2*a* means a portion which is provided between the casing 2 and the turbine rotor 3, and through which the steam is discharging.

As shown in FIG. 1, a starting control system 10 is connected with the control valve 6. The starting control system 10 is adapted for starting the turbine 4, while controlling the control valve 6 by obtaining an operational amount of the control valve 6.

The starting control system 10 includes a starting controller 11, which estimates a thermal stress $\sigma s(k+j)$ ($j=1, 2, \ldots, m$) generated in the turbine rotor 3 during a predetermined estimation time interval and an expansion difference $Exs(k+j)$, due to the thermal expansion, between an expansion of the casing 2 and an expansion of the turbine rotor 3, and calculating an operation pattern of the control valve 6 for each time step during the predetermined estimation time interval, thereby to obtain an operational amount of the control valve 6, based on the obtained operation pattern; and a control-valve controller 12 adapted for driving the control valve 6, based on the operational amount obtained by the starting controller 11. As used herein, the estimation time interval means a time interval between future points of time k+1 and k+m, each measured or defined after a current point of time k.

In addition, the start drive means 11 includes a first-stage steam-temperature and heat transfer coefficient estimator 13, which estimates a first-stage steam temperature $Ts(k+j)$ of the steam in the vicinity of the first stage 9 and a heat transfer coefficient $hf(k+j)$ of the steam in the vicinity of the first stage 9, for each time step during the estimation time interval, based on quantities of the state of the turbine system 1, such as conditions of the steam, rotating speed, load of the power generator.

In the case of estimating the first-stage steam temperature $Ts(k+j)$ and heat transfer coefficient $hf(k+j)$ by using the first-stage steam-temperature and heat transfer coefficient estimator 13, a pipe steam pressure Pms and a pipe steam temperature Tms of the steam in the main steam pipe 5, which corresponds to the conditions of the steam in the main steam pipe 5, actually measured before the current point of time, a rotating speed w of the turbine rotor 3, a load MW on the power generator 7 and an operation pattern of the control valve 6, which is obtained by an operational-amount calculator 20 as described later, are used, respectively.

It is noted that the operation pattern is expressed herein by using a turbine-speed increasing ratio $dw(k+j)$ indicative of a ratio of changing the rotating speed w of the turbine rotor 3 and a load increasing ratio $dMW(k+j)$ indicative of a ratio of increasing the load MW on the power generator 7. Such turbine-speed increasing ratio $dw(k+j)$ and load increasing ratio $dMW(k+j)$ used by the first-stage steam-temperature and heat transfer coefficient estimator 13, are respectively obtained by repeated calculations performed just before the estimation, for each time step during the estimation time interval, by the operational-amount calculator 20 as described later.

A first-stage metal-temperature estimator 14 is connected with the first-stage steam-temperature and heat transfer coefficient estimator 13. The first-stage metal-temperature estimator 14 estimates a first-stage metal-temperature changing ratio $dTmet(k+j)$ for each time step during the estimation time interval.

In the case of estimating the first-stage metal-changing ratio $dTmet(k+j)$ by using the first-stage metal-temperature estimator 14, the first-stage steam temperature $Ts(k+j)$ and heat transfer coefficient $hf(k+j)$, for each time step during the estimation time interval, estimated by the first-stage steam-temperature and heat transfer coefficient estimator 13, and a first-stage metal temperature Tmet indicative of the surface temperature of the turbine rotor 3 in the vicinity of the first stage 9 actually measured before the current point of time are used, respectively.

Further, a thermal stress estimator 15 is connected with the first-stage metal-temperature estimator 14. the thermal stress estimator 15 estimates the thermal stress σs(k+j) generated in the turbine rotor 3 for each time step during the estimation time interval.

In the case of estimating the thermal stress σs(k+j) by using the thermal stress estimator 15, the first-stage metal-temperature changing ratio dTmet(k+j) for each time step during the estimation time interval, estimated by the first-stage metal-temperature estimator 14, is used.

In addition, the starting controller 11 includes a passage-steam-temperature and flow-rate estimator 16, which estimates a passage steam temperature Tsp(k+j) and a passage steam flow rate Qsp(k+j) of the steam discharging through the steam passage 2*a*, for each time step during the estimation time interval.

In the case of estimating the passage steam temperature Tsp(k+j) and passage steam flow rate Qsp(k+j) by using the passage-steam-temperature and flow-rate estimator 16, the pipe steam pressure Pms, the pipe steam temperature Tms and the pipe steam flow rate Fl of the steam in the main steam pipe 5, which correspond to conditions of the steam in the main steam pipe 5, actually measured before the current point of time, the rotating speed w of the turbine rotor 3, the load MW on the power generator 7 and the operation pattern of the control valve 6, which is obtained by the operational-amount calculator 20 as described later, are used, respectively.

As described above, the turbine-speed increasing ratio dw(k+j) and load increasing ratio dMW(k+j) used by the passage-steam-temperature and flow-rate estimator 16 are respectively obtained by repeated calculations performed just before the estimation, for each time step during the estimation time interval, by the operational-amount calculator 20.

A rotor-temperature estimator 17 is connected with the passage-steam-temperature and flow-rate estimator 16. The rotor-temperature estimator 17 estimates a rotor-temperature changing ratio dTr(k+j) for each time step during the estimation time interval.

In the case of estimating the rotor-temperature changing ratio dTr(k+j) by using the rotor-temperature estimator 17, the passage steam temperature Tsp(k+j) and passage steam flow rate Qsp(k+j), for each time step during the estimation time interval, estimated by the passage-steam-temperature and flow-rate estimator 16, and a rotor temperature Tr of the turbine rotor 3 actually measured before the current point of time are used, respectively.

It is noted that not only the first-stage metal temperature Tmet but also the temperature actually measured, for example, at a central portion of the turbine rotor 3 may also be used as the rotor temperature Tr. Otherwise, the rotor temperature Tr may be estimated from the first-stage metal temperature Tmet and/or first-stage metal-temperature changing ratio dTmet (k+j), based on the material and/or shape of the rotor. In this case, the rotor temperature Tr may be determined as temperature values respectively estimated at several points of the turbine rotor 3.

Furthermore, a casing-temperature estimator 18 is connected with the passage-steam-temperature and flow-rate estimator 16. The casing-temperature estimator 18 estimates a casing-temperature changing ratio dTc(k+j) for each time step during the estimation time interval.

In the case of estimating the casing-temperature changing ratio dTc(k+j) by using the casing-temperature estimator 18, the passage steam temperature Tsp(k+j) and passage steam flow rate Qsp(k+j), for each time step during the estimation time interval, estimated by the passage-steam-temperature and flow-rate estimator 16, and a casing temperature Tc of the casing 2 actually measured before the current point of time are used, respectively.

Additionally, an expansion difference estimator 19 is connected with the rotor-temperature estimator 17 and casing-temperature estimator 18. The expansion difference estimator 19 estimates the expansion difference Exs(k+j) between the expansion of the casing 2 and the expansion of the turbine rotor 3, due to thermal expansion, for each time step during the estimation time interval. The expansion difference Ex actually measured by means (not shown) for actually measuring the expansion difference before the current point of time is input to the expansion difference estimator 19.

In the case of estimating the expansion difference Exs(k+j) by using the expansion difference estimator 19, the rotor-temperature changing ratio dTr(k+j) for each time step during the estimation time interval, estimated by the rotor-temperature estimator 17, and the casing-temperature changing ratio dTc(k+j) for each time step during the estimation time interval, estimated by the casing-temperature estimator 18, are used, respectively.

Further, the operational-amount calculator 20 is connected with the thermal stress estimator 15 and expansion difference estimator 19. As described above, the operational-amount calculator 20 is adapted for calculating the operation pattern of the control valve 6 during the estimation time interval, for each time step, and then obtaining the operational amount of the control valve 6 based on the calculated operation pattern.

In the case of obtaining the operational amount of the control valve 6 by using the operational-amount calculator 20, the operation pattern of the control valve 6 is calculated for each time step during the estimation time interval, such that the time required for starting the turbine 4 can be made shortest, while the thermal stress σs(k+j) for each time step during the estimation time interval, estimated by the thermal stress estimator 15, and the expansion difference Exs(k+j) for each time step during the estimation time interval, estimated by the expansion difference estimator 19, are controlled lower than defined values, respectively.

It is noted that the defined value for the thermal stress may be any value that will not significantly shorten the life span of the turbine rotor 3, while the defined value for the expansion difference may be any given value that can allow the turbine 4 to be operated, without causing any contact of the turbine moving blades 8*a* provided on the side of the turbine rotor 3 with the turbine nozzles 8*b* provided on the side of the casing 2.

Among the turbine-speed increasing ratio dw(k+j) and load increasing ratio dMW(k+j) respectively used in the operation pattern calculated as described above, a speed increasing ratio dwopt and a load increasing ratio dMWopt, in a first time step, is obtained the operational amount of the control valve 6 respectively.

Additionally, when the expansion difference Exs(k+j) actually measured in the current point of time exceeds the defined value, the operational-amount calculator 20 has a function for keeping the rotating speed w of the turbine rotor 3 and the load MW on the power generator 7 to be the rotating speed w of the turbine and the load MW of the power generator 7 at the current point of time, respectively.

Next, typical operation of this embodiment constructed as described above, i.e., one exemplary method for starting-controlling the turbine system according to the present invention, will be described.

In the case of starting the turbine 4 from a stopped state, as shown in FIG. 1, the pipe steam pressure Pms, the pipe steam temperature Tms and the pipe steam flow rate Fl, which correspond to the conditions of the steam in the main steam pipe 5, the rotating speed w of the turbine rotor 3, the load MW on the power generator 7, the first-stage metal temperature Tmet, which correspond to the surface temperature of the turbine rotor 3 in the vicinity of the first stage 9 (see FIG. 2), rotor temperature Tr of the turbine rotor 3 and casing temperature Tc in the casing are actually measured as quantities of state of the system or plant, before the current point of time (k), respectively.

Then, the first-stage steam temperature Ts(k+j) of the steam in the vicinity of the first stage 9 and the heat transfer coefficient hf(k+j) between the steam in the vicinity of the first stage 9 and the surface of the turbine rotor 3 in the vicinity of the first stage 9, for each time step during the estimation time interval, are estimated, respectively, by using the first-stage steam-temperature and heat transfer coefficient estimator 13, based on the pipe steam pressure Pms, the pipe steam temperature Tms, the rotating speed w of the turbine and the load MW on the power generator, actually measured respectively, as well as based on the turbine-speed increasing ratio dw(k+j) (j=1, 2, . . . , m) and the load increasing ratio dMW (k+j), respectively obtained by the repeated calculations, performed just before the estimation, for each time step during the estimation time interval, by the operational-amount calculator 20.

Subsequently, the first-stage metal-temperature changing ratio dTmet(k+j) for each time step during the estimation time interval is estimated, by using the first-stage metal-temperature estimator 14, based on the first-stage steam temperature Ts(k+j) and heat transfer coefficient hf(k+j) estimated by the first-stage steam-temperature and heat transfer coefficient estimator 13 as well as on the actually measured first-stage metal temperature Tmet.

Thereafter, the thermal stress σs(k+j) generated in the turbine rotor 3 for each time step during the estimation time interval is estimated, by using the thermal stress estimator 15, based on the first-stage metal-temperature changing ratio dTmet(k+j) estimated by the first-stage metal-temperature estimator 14.

While the first-stage steam temperature Ts(k+j) and heat transfer coefficient hf(k+j) are estimated by the first-stage steam-temperature and heat transfer coefficient estimator 13, the passage steam temperature Tsp(k+j) of the steam discharging through the steam passage 2*a* and passage steam flow rate Qsp(k+j) of the steam, for each time step during the estimation time interval, are estimated, by using the passage-steam-temperature and flow-rate estimator 16, based on the pipe steam pressure Pms, the pipe steam temperature Tms, the rotating speed w of the turbine, the load MW on the power generator and the pipe steam flow rate Fl actually measured respectively, as well as on the turbine-speed increasing ratio dw(k+j) and the load increasing ratio dMW(k+j) respectively obtained by the repeated calculations performed just before the estimation, for each time step during the estimation time interval, by the operational-amount calculator 20.

Then, the rotor-temperature changing ratio dTr(k+j) for each time step during the estimation time interval is estimated, by using the rotor-temperature estimator 17, based on the passage steam temperature Tsp(k+j) and the passage steam flow rate Qsp(k+j) estimated by the passage-steam-temperature and flow-rate estimator 16 as well as on the actually measured rotor temperature Tr.

Thereafter, the casing-temperature changing ratio dTc(k+j) for each time step during the estimation time interval is estimated, by using the casing-temperature estimator 18, based on the passage steam temperature Tsp(k+j) and the passage steam flow rate Qsp(k+j) estimated by the passage-steam-temperature and flow-rate estimator 16 as well as on the actually measured casing temperature Tc.

Subsequently, the expansion difference Exs(k+j), due to the thermal expansion, between the expansion of the casing 2 and the expansion of the turbine rotor 3, for each time step during the estimation time interval, is estimated, by using the expansion difference estimator 19, based on the rotor-temperature changing ratio dTr(k+j), for each time step during the estimation time interval, estimated by the rotor-temperature estimator 17 as well as on the casing-temperature changing ratio dTc(k+j), for each time step during the estimation time interval, estimated by the casing-temperature estimator 18. In this case, the expansion of the casing 2 is first estimated, and then the expansion of the turbine rotor 3 is estimated, and thereafter the expansion difference Exs(k+j) between the expansion of the casing 2 and the expansion of the turbine rotor 3 is obtained.

Thereafter, the operational amount of the control valve 6 is obtained by the operational-amount calculator 20. In this case, the thermal stress σs(k+j) for each time step during the estimation time interval, estimated by the thermal stress estimator 15, and the expansion difference Exs(k+j) for each time step during the estimation time interval, estimated by the expansion difference estimator 19, are first controlled lower than the defined values, respectively, and then the operation pattern of the control valve 6 during the estimation time interval, i.e., the turbine-speed increasing ratio dw(k+j) of the turbine rotor 3 and the load increasing ratio dMW(k+j) of the power generator 7, are calculated, respectively, for each time step, such that the time required for starting the turbine 4 can be made shortest, based on the thermal stress σs(k+j) and the expansion difference Exs(k+j).

Then, the turbine-speed increasing ratio dw(k+j) and the load increasing ratio dMW(k+j) calculated by the operational-amount calculator 20 are fed back to the first-stage steam-temperature and heat transfer coefficient estimator 13 and the passage-steam-temperature and flow-rate estimator 16, respectively, and then used for a next calculation. In this way, a procedure of the calculations as described above, for each time step during the estimation time interval, is repeated until each desired condition can be established.

After, the repeated calculations are completed, the operational turbine speed increasing ratio dwopt and the operational load increasing ratio dMWopt are obtained, respectively, as the operational amount of the control valve 6, by using the operational-amount calculator 20, based on values of the turbine-speed increasing ratio dw(k+j) and the load increasing ratio dMW(k+j), for the first time step (k+1) during the estimation time interval.

As a result, the control valve 6 is driven by the control-valve controller 12, based on the operational turbine speed increasing ratio dwopt and operational load increasing ratio dMWopt, respectively obtained as the operational amount of the control valve 6 by using the operational-amount calculator 20 of the starting controller 11. Namely, the degree of opening the control valve 6 is controlled based on the operational amount, and thus the flow rate of the steam discharging into the casing 2 through the main steam pipe 5 and control valve 6 from the steam generator (not shown), such as a boiler or the like, can be controlled.

If the expansion difference, actually measured by a means (not shown) for actually measuring the expansion difference Ex before the current point of time, exceeds the defined value, the rotating speed w of the turbine rotor 3 and the load MW on the power generator 7 are kept to be the rotating speed w of the turbine and the load MW of the power generator at the current point of time, respectively, by the operational-amount calculator 20. In this case, the system can perform not only a comparison between the estimated expansion difference Exs and the defined value thereof but also the comparison between the actually measured expansion difference Ex and the defined value, thereby to securely prevent the turbine moving blades 8*a* provided on the side of the turbine rotor 3 from being in contact with the turbine nozzles 8*b* provided on the side of the casing 2.

Thereafter, the pressure of the steam discharging into the casing 2 is applied to each turbine moving blade 8*a* of the plurality of stages 8 provided on the outer circumference of the turbine rotor 3, thus rotating the turbine rotor 3 and allowing the power generator 7 coupled with the turbine rotor 3 to generate electricity.

Subsequently, the time step (k+1) corresponding to the operational turbine speed increasing ratio dwopt and the operational load increasing ratio dMWopt, respectively obtained as the operational amount of the control valve 6, is altered to the current point of time, and then the procedure of calculations as described above is performed for a newly set estimation time interval. In this way, the operation pattern of the control valve 6 is altered successively by the operational-amount calculator 20, and thus the operational amount of the control valve 6 is controlled based on each altered operation pattern, so as to start and operate the turbine 4.

FIG. 3(*a*) shows each change of the pipe steam pressure Pms and the pipe steam temperature Tms of the steam in the main steam pipe 5, the rotating speed w of the turbine rotor 3 and the load MW on the power generator 7, in the case of starting the turbine 4, as described above. FIG. 3(*b*) shows a change of the estimated thermal stress σs(k+j), and FIG. 3(*c*) shows a change of the estimated expansion difference Exs(k+j). From these FIGS. 3(*b*) and 3(*c*), it can be seen that both of the thermal stress σs(k+j) and the expansion difference Exs (k+j) are controlled to be lower than the defined values, respectively, when the turbine 4 is started.

As described above, according to this embodiment, the time required for starting the turbine 4 can be made shortest, while both of the thermal stress of the turbine rotor 3 and the expansion difference between the expansion of the turbine rotor 3 and the expansion of the casing 2 are controlled to be lower than the defined values, respectively. Thus, the turbine 4 can be started and operated, successfully, without substantially shortening the life span of the turbine rotor 3, while preventing the contact between the turbine moving blades 8*a* provided on the side of the turbine rotor 3 and the turbine nozzles 8*b* provided on the side of the casing 2. Further, the time gap from starting time of the turbine 4 to a time when the electric power generated by the power generator can be sold, can be significantly shortened. Therefore, loss of a chance for selling the obtained electric power after the turbine 4 is started can be successfully avoided.

In this embodiment, when the passage steam temperature Tsp(k+j) and the passage steam flow rate Qsp(k+j) is obtained by the passage-steam-temperature and flow-rate estimator 16, the actually measured pipe steam flow rate Fl is used. However, the passage steam temperature Tsp(k+j) and the passage steam flow rate Qsp(k+j) may also be obtained by calculating the pipe steam flow rate Fl by using the pressure of the steam and the valve opening degree actually measured at an entrance of the control valve 6, as the quantities of state of the system or plant.

Variation of the Invention

Next, one variation of the turbine system according to this invention will be described. This variation is configured to stop the rotation of the turbine rotor when the expansion difference Ex actually measured exceeds the defined value. However, the other construction is substantially the same as the above first embodiment shown in FIGS. 1 to 3.

In this variation, when the expansion difference Ex, actually measured before the current point of time by the means (not shown) for actually measuring the expansion difference, exceeds the defined value, the rotation of the turbine rotor 3 is stopped by the operational-amount calculator 20. In this way, unwanted contact between the turbine moving blades 8*a* provided on the side of the turbine rotor 3 and the turbine nozzles 8*b* provided on the side of the casing 2 can be securely prevented.

Second Embodiment

Figure 4:
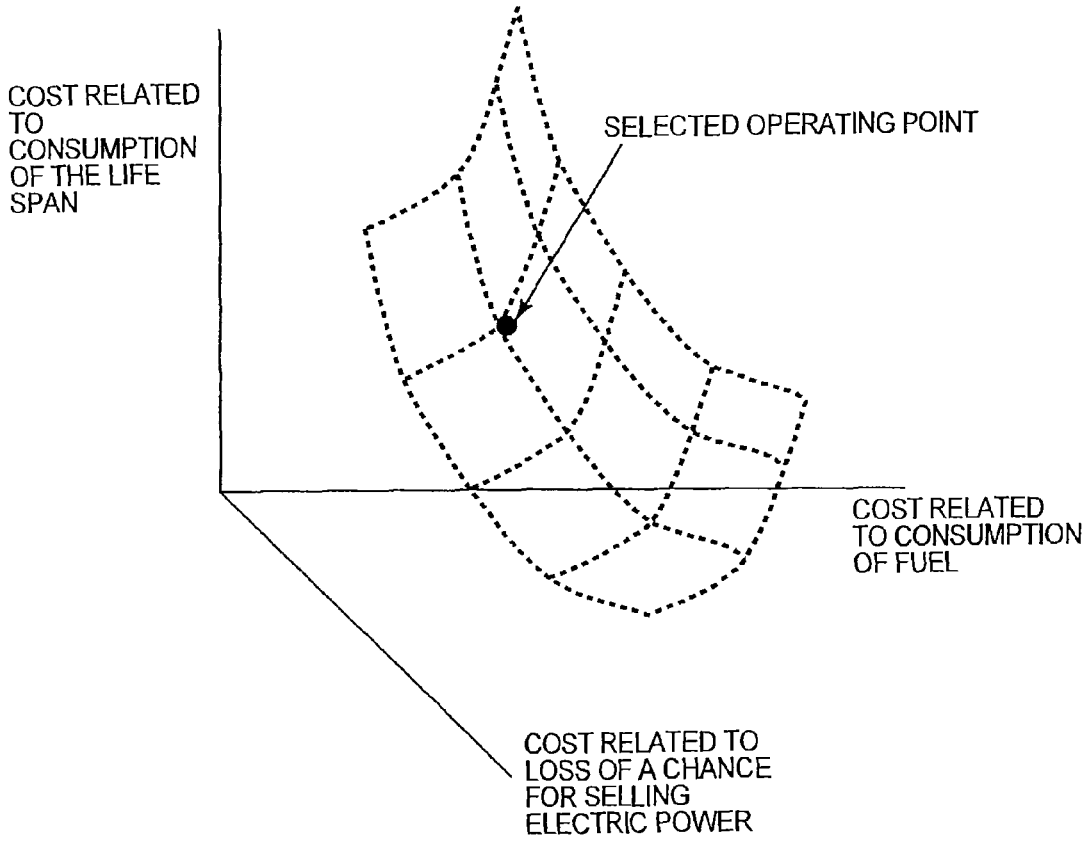
FIG. 4 is a view showing a relationship of a cost related to consumption of the life span, a cost related to consumption of fuel and a cost related to loss of a chance for selling electric power, in the turbine system related to a second embodiment.

Referring now to FIG. 4, the turbine system related to a second embodiment of the present invention will be described.

In the second embodiment shown in FIG. 4, the turbine system is different from the first embodiment, in that the cost related to consumption of the life span, the cost related to consumption of fuel and the cost related to loss of a chance for selling the obtained electric power are considered when the operation pattern is obtained. However, the other construction is substantially the same as the first embodiment shown in FIGS. 1 to 3. It is noted that like parts shown in FIG. 4 are respectively designated by like reference numerals assigned to those of the first embodiment shown in FIGS. 1 to 3, and detailed explanation on such parts will be omitted below.

The thermal stress estimator 15 (see FIG. 1) of this embodiment has a function for assessing the consumed life span of the turbine rotor 3, while considering consumption of the life span of the turbine rotor 3, based on the thermal stress σs(k+j) generated in the turbine rotor 3 for each step during the predetermined estimation time interval. Specifically, in the first embodiment, the turbine is started, while being controlled such that the thermal stress σs(k+j) generated in the turbine rotor 3 can be controlled to be lower than the defined value. However, the defined value of the thermal stress σs(k+j) is set based on consumption of the life span of the turbine 4.

Namely, the maximum thermal stress generated upon starting the turbine reduces the life span of the turbine rotor 3, in nature, by a certain period of time. Therefore, in the second embodiment, the defined value of the thermal stress is not set at a fixed value. Instead, the thermal stress estimator 15 of the starting controller 11 is configured to set a certain relationship between the maximum value of the thermal stress and consumption of the life span of the turbine system. In this way, the cost related to consumption of the life span of the turbine rotor 3 for each time step is calculated, based on such a relationship between the life span obtained in advance for the turbine rotor 3 and the cost required for exchanging such turbine rotors 3.

In addition, the operational-amount calculator 20 (see FIG. 1) has a function for obtaining the cost related to consumption of fuel consumed upon starting the turbine rotor 3, based on the operation pattern of the control valve 6, i.e. the turbine-speed increasing ratio dw(k+j) and load increasing ratio dMW(k+j) on the power generator 7 for each time step during the estimation time interval. Further, the operational-amount calculator 20 has a function for calculating the cost related to loss of the chance for selling electric power generated by the power generator from the starting time of the turbine to a time when the electric power generated by the power generator can be sold.

In the second embodiment, when the turbine 4 is started, an operator for starting-operating the turbine 4 select desired conditions for starting the turbine 4, based on the relationship of the cost related to consumption of the life span, the cost related to consumption of the fuel and the cost related to loss of the chance for selling electric power generated by the power generator. Namely, when the operator selects the conditions corresponding to a desired operating point as designated in FIG. 4, the appropriate operation pattern is calculated by the operational-amount calculator 20, based on such selected conditions.

As described above, according to the second embodiment, if the operator wants to control consumption of the life span of the turbine rotor 3 upon starting the turbine 4, proper conditions for controlling the cost related to consumption of the life span can be selected. Meanwhile, if the operator wants to control consumption of the fuel upon starting the turbine 4, other desired conditions for controlling the cost related to consumption of the fuel can be selected. Furthermore, if the operator wants to sell the electric power generated by the power generator 7 without losing the chance for selling the electric power, still other conditions for controlling the cost related to loss of the chance for selling the electric power can be selected.

Thus, the turbine 4 can be started, while the time required for starting the turbine 4 can be made shortest, with the thermal stress of the turbine rotor 3 and the expansion difference between the expansion of the turbine rotor 3 and the expansion of the casing 2 being controlled, respectively, lower than the defined values. Besides, the turbine 4 can be started and operated, while the starting conditions can be optionally selected, based on the relationship of the cost related to consumption of the life span, the cost related to consumption of the fuel and the cost related to loss of the chance for selling the electric power.

This application claims priority from Japanese Patent Application 2008-133366, filed May 21, 2008, which is incorporated herein by reference in its entirety.

The invention claimed is:

1. A turbine system comprising:

a turbine having a casing and a turbine rotor rotatably attached into the casing;

a main steam pipe connected to an upstream portion of the casing of the turbine;

a control valve provided with the main steam pipe, the control valve controls a flow rate of steam discharging into the casing;

a power generator coupled with the turbine rotor; and a starting control system including a starting controller and a control-valve controller, wherein the starting controller, during a estimation time interval, estimates thermal stress generated in the turbine rotor and an expansion difference between the casing and the turbine rotor due to thermal expansion, based on conditions of the steam discharging into the casing, temperature of the turbine rotor and a temperature of the casing, wherein the starting controller, for each time step, calculates an operation pattern of the control valve during the estimation time interval such that the thermal stress and the expansion difference, estimated respectively, can be controlled to be lower than defined values, thereby obtaining an operational amount of the control valve based on the operation pattern; and wherein the control-valve controller drives the control valve, based on the operational amount obtained by the starting controller.

2. The turbine system according to claim 1, wherein turbine moving blades are provided on an outer circumference of the turbine rotor, and turbine nozzles are provided in the casing, with a steam passage being formed by providing a plurality of stages, each stage being composed of a pair of the turbine nozzle and the turbine moving blade, wherein the starting controller of the starting control system estimates a first-stage steam temperature of the steam in the vicinity of a first stage and a heat transfer coefficient of the steam in the vicinity of the first stage, for each time step during the estimation time interval;

wherein the starting controller further estimates a first-stage metal-temperature changing ratio, for each time step during the estimation time interval, based on the first-stage steam temperature, the heat transfer coefficient and a first-stage metal temperature of the first stage;

wherein the starting controller further estimates the thermal stress generated in the turbine rotor, for each time step during the estimation time interval, based on the first-stage metal-temperature changing ratio;

wherein the starting controller further estimates a passage steam temperature and a passage steam flow rate of the steam discharging through the steam passage, for each time step during the estimation time interval, based on the conditions of the steam discharging into the casing;

wherein the starting controller further estimates a rotor-temperature changing ratio, for each time step during the estimation time interval, based on the passage steam temperature, the passage steam flow rate and a rotor temperature of the turbine rotor;

wherein the starting controller further estimates a casing-temperature changing ratio, for each time step during the estimation time interval, based on the passage steam temperature, the passage steam flow rate and a casing temperature of the casing;

wherein the starting controller further estimates an expansion difference due to thermal expansion, between the casing and the turbine rotor, for each time step during the estimation time interval, based on the rotor-temperature changing ratio and the casing-temperature changing ratio.

3. The turbine system according to claim 2, wherein the starting controller estimates the first-stage steam temperature and the heat transfer coefficient based on a pipe steam pressure and a pipe steam temperature of the steam in the main steam pipe, rotating speed of the turbine rotor, load of the power generator and the calculated operation pattern.

4. The turbine system according to claim 2, wherein the starting controller estimates the passage steam temperature and the passage steam flow rate based on a pipe steam pressure, a pipe steam temperature and a pipe steam flow rate of the steam in the main steam pipe, rotating speed of the turbine rotor and load of the power generator and the calculated operation pattern.

5. The turbine system according to claim 2, wherein the starting controller assesses the consumed life span of the turbine rotor based on the estimated thermal stress generated in the turbine rotor, for each time step during the estimation time interval.

6. The turbine system according to claim 5, wherein the starting controller obtains the cost related to consumption of fuel consumed upon starting the turbine rotor, based on the obtained operation pattern and the cost related to loss of a chance for selling power generated by the generator, and wherein the starting controller calculates the operation pattern for the control valve during the estimation time interval, for each time step, based on the consumed life span of the turbine rotor, the cost related to consumption of fuel and the cost related to loss of the chance for selling the power.

7. The turbine system according to claim 2, wherein the starting controller sets the operational amount of the control valve so as to the keeps the rotating speed of the turbine rotor and the load of the power generator when the expansion difference actually measured exceeds the defined value.

8. The turbine system according to claim 2, wherein the starting controller set the operational amount of the control valve so as to stop the rotation of the turbine rotor, when the expansion difference actually measured exceeds the defined value.

9. A method for starting-controlling a turbine system including a turbine having a casing and a turbine rotor rotatably attached into the casing, a main steam pipe connected to an upstream portion of the casing of the turbine, a control valve provided with the main steam pipe, the control valve controls a flow rate of steam discharging into the casing, a power generator coupled with the turbine rotor, and a starting control system including a starting controller and a control-valve controller, wherein the method comprises:

estimating, by the starting controller of the starting control system, thermal stress generated in the turbine rotor during a estimation time interval, and an expansion difference, due to thermal expansion, between the casing and the turbine rotor, based on conditions of the steam discharging into the casing as well as a temperature of the turbine rotor and a temperature of the casing and then calculating an operation pattern of the control valve during the estimation time interval, for each time step, such that the thermal stress and the expansion difference estimated respectively can be controlled to be lower than defined values, respectively, thereby obtaining an operational amount of the control valve, based on the operation pattern; and driving the control valve by the control-valve controller of the starting control system, based on the operational amount of the control valve obtained by the starting controller.

* * * * *